US007033980B2

(12) United States Patent
Waits et al.

(10) Patent No.: US 7,033,980 B2
(45) Date of Patent: Apr. 25, 2006

(54) AUTOMATIC DISHWASHING DETERGENT COMPOSITION COMPRISING ENCAPSULATED GLASSCARE ACTIVE SALT

(75) Inventors: Leslie Dawn Waits, Cincinnati, OH (US); Anju Deepali Massey Brooker, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 52 days.

(21) Appl. No.: 10/713,452

(22) Filed: Nov. 14, 2003

(65) Prior Publication Data

US 2004/0121926 A1 Jun. 24, 2004

Related U.S. Application Data

(60) Provisional application No. 60/426,429, filed on Nov. 14, 2002.

(51) Int. Cl.
*C11D 3/22* (2006.01)
*C11D 3/00* (2006.01)

(52) U.S. Cl. ..... 510/221; 510/220; 510/521

(58) Field of Classification Search ..... 510/220, 510/221, 521
See application file for complete search history.

(56) References Cited

U.S. PATENT DOCUMENTS 2,768,169 A * 10/1956 Haskell et al. ..... 546/352
5,324,445 A * 6/1994 Langley et al. ..... 510/321
6,093,343 A * 7/2000 Addison et al. ..... 252/186.33

* cited by examiner

*Primary Examiner*—Yogendra N. Gupta
*Assistant Examiner*—John M. Petruncio
(74) *Attorney, Agent, or Firm*—Jeffrey V. Bamber; Kim W. Zerby; Steven W. Miller

(57) ABSTRACT

An automatic dishwashing detergent composition is disclosed in one embodiment comprises: (a) an encapsulated glasscare active salt; (b) at least one detergent component; (c) optionally at least one adjunct material; and (d) balance water.

12 Claims, No Drawings

AUTOMATIC DISHWASHING DETERGENT COMPOSITION COMPRISING ENCAPSULATED GLASSCARE ACTIVE SALT

CROSS REFERENCE TO RELATED APPLICATION

This application claims the benefit of the filing date of U.S. Provisional Patent Application No. 60/426,429, filed Nov. 14, 2002.

FIELD OF INTEREST

The present invention is in the field of dishwashing, in particular it relates to dishwashing and automatic dishwashing products, auxiliaries and methods suitable for cleaning and protecting glassware.

BACKGROUND

Automatic dishwashing detergents constitute a generally recognized distinct class of detergent compositions whose purpose can include to breakdown and remove food soils; to inhibit foaming; to promote the wetting of wash articles in order to minimize or eliminate visually observable spotting and filming; to remove stains such as might be caused by beverages such as coffee and tea or by vegetable soils such as carotenoid soils; to prevent a buildup of soil films on wash ware surfaces; and to reduce or eliminate tarnishing of flatware without substantially etching or corroding or otherwise damaging the surface of glasses or dishes.

The problem of glassware corroding during washing the cycle of an automatic dishwashing appliance has long been known. Current opinion is that the problem of corrosion in glassware is the result of two separate phenomena. On the one hand, the corrosion is clearly due to minerals from the glass composition accompanied by hydrolysis of the silicate network. On the other hand, silicate material is released from the glass. After several washes in an automatic dishwashing appliance, both phenomena can cause damage to glassware such as cloudiness, scratches, and streaks.

Dissolution of the glassware's silicate network is known to be very low at pH values below 9.5 and increases with increasing pH. In institutional and domestic automatic dishwashing compositions, a strongly alkaline solution is produced and is used to wash dishes, glasses, and other cooking and eating utensils. Ordinary tap water can be used in preparing these strongly alkaline cleaning solutions and for rinsing the wash articles subsequent to the cleaning step. However, in European and in some North American (i.e. water softener users) applications, this tap water is often treated (softened) to remove hardness ions such as calcium and magnesium with the result that hard water residues on washware are reduced.

An unfortunate weakness in the performance of institutional and domestic automatic dishwashing compositions, both in compositions which are phosphated (i.e., containing inorganic phosphate builder salts) and those which are nonphosphated, is that they are particularly prone to attacking glasses and plates. Furthermore, the high alkalinity and high levels of builders add to corrosive effect on glassware. Thus, there is a continuing need to develop alternative automatic dishwashing compositions that provide the above-mentioned benefits yet reduce the problem of glassware corrosion.

One approach to reducing glassware corrosion is to provide an automatic dishwashing composition comprising silicate. One approach is to provide an automatic dishwashing composition with a mixture of disilicate and metasilicate. Another approach is to provide an additive to an automatic dishwashing composition, such as, a copolymer of an organomineral siliconate, obtained by condensation polymerization of an alkali metal disilicate and an alkali metal siliconate. Another approach is to provide an automatic dishwashing composition with an alkali metal silicate partially substituted with calcium, magnesium, strontium or cerium as counterion. However, automatic dishwashing compositions comprising specific silicates or modified silicates to avoid dishwashing corrosion restricts the type of formulation to which these solutions are applicable. In particular, corrosion of glassware can be quite severe with compositions of low alkalinity, where silicates are of limited use because of their low stability.

Recently, another approach is the use of metal salts, particularly of aluminum, wherein the metal salt is sequestered to form a metal salt-sequestrant complex, such as, an aluminum(III)-sequestrant complex. In one example, a slow-dissolving aluminum salt is sequestered to form the aluminum(III)-sequestrant complex, which is added as a premix to an automatic detergent composition in the absence of silicate. Since these particular salts dissolve at a particular rate, they severely limit the selection of aluminum(III) species, which are useful. Another example of such an approach requires the selection of specific pKas and pHs to form an aluminum/sequestrant premix. However, the usefulness of these aluminum/sequestrant premix formulations is limited. In another example, the aluminum/sequestrant premix must be added as an additional step to the process of forming the detergent compositions which adds cost to its commercial application. In another approach, a fast-dissolving aluminum salt is used yet must be combined with greater than about 10 wt. % silicate in high alkalinity products to avoid corrosion since corrosion is especially pronounced in alkaline automatic dishwashing compositions having an absence of silicate. However, the sequestering process is complicated since is composed of multiple process steps and involves precise adjustment of pH and the aluminum/sequestrant complex is limited to detergent compositions wherein a 1% aqueous solution of the composition has a pH of 9.

A cost effective and simple approach to reducing glassware corrosion is to provide a glasscare active salt, for example an aluminum salt such as aluminum sulfate, to the automatic dishwashing composition. However, there are several drawbacks to this approach. For example, soluble (or slightly soluble) glasscare active salts in gel detergent lead to clumping of the gel product, which can also cause phase separation in certain detergents. These salts can also lead to a reduction in the cleaning performance for tea, stains by interfering with the bleach during the wash cycle.

One way to overcome the drawbacks disclosed above is through encapsulation. A variety of materials and methods can be used to coat particles. The majority of the encapsulation effort, however, has been directed to bleach and enzyme encapsulation. In particular, bleach and enzyme particles can be single-coated with fatty acids, polyvinyl alcohol or polyethylene glycols or double-coated with an inner coat of paraffin or microcrystalline waxes having melting points of 40°–94° C. and a second coat of material such as sodium carbonate. Alternatively, the double-coated encapsulated bleach and enzyme particles may have an inner coat of fatty acid or waxes and an outer coat of water-soluble cellulose ether. Other encapsulating coatings for bleach and enzyme particles include polymer latex; polycarboxylate materials; polyethylene waxes of melting point 50°–65° C.; and various other waxes. The bleach and enzyme particles may also be coated with ethylene vinyl acetate, fatty acid, natural waxes, a synthetic resin or an inorganic coating. For example, the bleach and enzyme particles may be coated with silicone oil, petroleum jelly or alcohol waxes. Some precursor particles used in cleaning compositions have also been encapsulated with liquid paraffin waxes and polyvinyl alcohol.

It has surprisingly been found that by protecting certain glasscare active salts from dissolving in (or reacting with) the detergent composition good glassware corrosion protection can be achieved during washing and/or rinsing cycles of an automatic dishwashing appliance. The drawback of clumping in gels can be avoided and the interaction of the glasscare active salts with detergent components can be minimized in liquids, powders and tablets by use of encapsulated glasscare active salts. The release of the encapsulated glasscare active salt can be delayed or sequenced depending on the type of encapsulating coating used. Thus, by sequencing and/or delaying the release of the glasscare active salts in detergent compositions by encapsulation, bleaching agents, like oxygen bleach, can be used to remove tea stains before the glasscare active salt has time to react with the stain.

SUMMARY OF THE INVENTION

An automatic dishwashing detergent composition is disclosed that comprises: (a) from about 0.01% and about 70%, by weight of the composition of a glasscare active salt; (b) at least one detergent component; (c) optionally at least one adjunct material; and (d) balance water. The glasscare active salt is encapsulated via at least one encapsulating agent, which provides at least one encapsulating coating to a glasscare active salt. The automatic dishwashing detergent composition may in any form including, but not limited to, liquid, liquid gel, gel, paste, cream, granular solid, powder, or combinations thereof. In some embodiments, glassware is protected from corrosion and fading. The combinations of the automatic dishwashing detergent composition with a method, and a kit are also disclosed herein.

DETAILED DESCRIPTION OF THE INVENTION

Glasscare Active Salt

An automatic dishwashing detergent composition is disclosed herein that comprises an encapsulated glasscare active salt (hereinafter "EGAS composition") comprising at least one of the following: aluminum, zinc, magnesium, calcium, lanthanum, tin, gallium, strontium, titanium, or mixtures thereof. Any convenient water-soluble or water-insoluble glasscare active salt can be used herein. The glasscare active salt may be in the form of a core particle, aggregate of core particles, prill, agglomerate, or combinations thereof. These forms may be nonfriable for handling during processing and when used by consumers. They may also be water-soluble, or water dispersible, or they may dissolve, disperse or melt in a temperature range of from about 40° C. to about 50° C.

The glasscare active salt may be generally incorporated in an EGAS composition in any suitable amount. In some embodiments, the EGAS composition may deliver from about 0.1 mM to about 10 mM, about 0.5 mM to about 5 mM, or about 1 mM to 2 mM of the glasscare active salt or complex in the wash and/or rinse liquor. In one embodiment, the level of glasscare active salt that achieves a glassware protection benefit may be an amount between from about 0.01% and about 70%, by weight of the composition.

In one non-limiting embodiment, the EGAS composition may comprise an encapsulated aluminum salt comprising water-soluble aluminum salt, water-insoluble aluminum salt, slightly water-soluble aluminum salt, or mixtures thereof.

Water-soluble aluminum salts include, but are not limited to: aluminum acetate, aluminum ammonium sulfate, aluminum chlorate, aluminum chloride, aluminum chloride hydrate, aluminum chlorohydrate, aluminum diformate, aluminum formoacetate, aluminum monostearate, aluminum lactate, aluminum nitrate, aluminum sodium sulfate, aluminum sulfate, aluminum stearate, aluminum tartrate, aluminum triformate, and mixtures thereof. Water-insoluble or slightly soluble aluminum salts include aluminum acetylacetonate, aluminum bromide, aluminum-n-butoxide, aluminum fluoride, aluminum fluosilicate, aluminum oxylate, aluminum oxide, aluminum phosphate, aluminum salicylate, and mixtures thereof. The term "slow dissolving" aluminum salt refers to an aluminum salt that dissolves at a rate to yield less than 0.56 mM aluminum(III) per minute at 42° C. Slow dissolving aluminum salts include, but are not limited to: aluminum stearate, aluminum tartrate, aluminum acetate, aluminum acetotartrate, aluminum salicylate, aluminum bis (acetylsalicylate), aluminum formate, aluminum octoate, aluminum borate, aluminum oleate, aluminum palmitate, aluminum acetylacetonate, aluminum phosphate, and mixtures thereof.

In another non-limiting embodiment, the EGAS composition may comprise an encapsulated zinc salt comprising water-soluble zinc salt, water-insoluble zinc salt, slightly water-soluble zinc salt, or mixtures thereof.

Water-soluble zinc salts include, but are not limited to: zinc bromate, zinc bromide, zinc chloride, zinc chloroiodide, zinc formate, zinc gluconate, zinc hydrosulfite, zinc iodide, zinc malate, zinc permanganate, zinc sulfate, zinc sulfate monohydrate, zinc sulfamate, zinc thiocyanate, and mixtures thereof. The less water-soluble zinc salts include, but are not limited to: zinc bacitracin, zinc borate, zinc carbonate, zinc basic carbonate (approximately Zn2 (OH)2 CO3), zinc fluoride, zinc fluorosilicate, zinc hydroxide, zinc laurate, zinc monophosphate (Zn3 (PO4)2), zinc oxalate, zinc oxide, zinc perborate, zinc peroxide, zinc phosphate, zinc pyrophosphate (Zn2 (P2 O7)), zinc resinate, zinc silicate, zinc stearate, zinc sulfide, zinc sulfite, zinc zirconium silicate, and mixtures thereof.

In another non-limiting embodiment, the EGAS composition may comprise an encapsulated magnesium salt comprising water-soluble magnesium salt, water-insoluble magnesium salt, slightly water-soluble magnesium salt, or mixtures thereof.

Water-soluble magnesium salts include, but are not limited to: magnesium acetate, magnesium acetylacetonate, magnesium ammonium phosphate, magnesium benzoate, magnesium biophosphate, magnesium borate, magnesium borocitrate, magnesium bromate, magnesium bromide, magnesium calcium chloride, magnesium chlorate, magnesium chloride, magnesium citrate, magnesium dichromate, magnesium fluosilicate, magnesium formate, magnesium gluconate, magnesium glycerophosphate, magnesium lauryl sulfate, magnesium nitrate, magnesium perchlorate, magnesium permanganate, magnesium salicylate, magnesium stannate, magnesium stannide, magnesium sulfate, and mixtures thereof. The less water-soluble magnesium salts include, but are not limited to: magnesium carbonate, magnesium chromate, magnesium fluoride, magnesium oleate, magnesium palmitate, magnesium perborate, magnesium phosphate, magnesium pyrophosphate, magnesium silicate, magnesium stearate, magnesium sulfite, magnesium trisilicate, magnesium tungstate, magnesium zirconium silicate, and mixtures thereof.

In another non-limiting embodiment, the EGAS composition may comprise an encapsulated calcium salt comprising water-soluble calcium salt, water-insoluble calcium salt, slightly water-soluble calcium salt, or mixtures thereof.

Water-soluble calcium salts include, but are not limited to: calcium acetate, calcium acetylsalicylate, calcium acrylate, calcium ascorbate, calcium borate, calcium bromate, calcium bromide, calcium chlorate, calcium chloride, calcium cyclamate, calcium dehydroacetate, calcium dichromate, calcium disodim edetate, calcium ethylhexoate, calcium formate, calcium gluconate, calcium iodate, calcium nitrite, calcium pantothenate, calcium perborate, calcium perchlorate, calcium permanganate, calcium propionate, calcium tartate, and calcium thiocynnate, and mixtures thereof. The less water-soluble calcium salts include, but are not limited to: calcium alginate, calcium biophosphate, calcium carbonate, calcium chromate, calcium citrate, calcium fluoride, calcium glycerophosphate, calcium iodobehenate, calcium iodobehenate, calcium metasilicate, calcium oleate, calcium oxalate, calcium palmitate, calcium phosphate, calcium phosphite, calcium phytate, calcium pyrophosphate, calcium resinate, calcium silicate, calcium sorbate, calcium stearate, calcium steary lactyalate, calcium sulfate, calcium sulfite, calcium thioglycollate, calcium tungstate, calcium zirconium silicate, and mixtures thereof.

Alternatively, water-soluble or water-insoluble salts comprising lanthanum, tin, gallium, strontium, titanium, and combinations thereof may also be used.

Encapsulating Agents

The encapsulating agents disclosed herein may provide at least one encapsulating coating to a glasscare active salt core particle, aggregate of core particles, prill, agglomerate, and mixtures in any suitable thickness. The at least one encapsulating coating may comprise a single-coat, multiple-coats, and combinations thereof in any suitable thickness. Encapsulating agents include, but are not limited to, fatty acids, polyvinyl alcohol, polyethylene glycols, builders, water-soluble cellulose and/or cellulose ether, polymers, polymer latex; polycarboxylate materials, ethylene vinyl acetate, polyvinyl alcohol, polyethylene waxes of melting point 50°–65° C., natural waxes, paraffin or microcrystalline waxes having melting points of 40°–94° C., liquid paraffin waxes, alcohol waxes, synthetic resin, silicone oil, petroleum jelly, inorganic coatings, or mixtures thereof.

In one non-limiting embodiment, the at least one encapsulating agent may comprise polymers, polymer latex, polycarboxylate materials, ethylene vinyl acetate, polyvinyl alcohol, or mixtures thereof. In other non-limiting embodiments, when the EGAS composition is in the form of a granular solid, powder, or mixtures thereof, the at least one encapsulating coating is substantially free of low critical solution temperature polymers. For example, low critical solution temperature polymers include those selected from the group consisting of alkylated and/or hydroxyalkylated polysaccharides, cellulose ethers, polyisoproplylacrylamine, copolymers of polyisopropylacrylamide, and mixtures thereof.

In an alkaline or highly alkaline environment, encapsulation decreases the chemical degradation of the glasscare active salt prior to its release. Encapsulated glasscare active salts also provide product stability in detergent compositions by inhibiting interaction of the glasscare active salt with other detergent components, such as buffers, bleaches and polymers. For example, glasscare active salts will interact negatively with thickeners (i.e. polyacrylates) and bleaches in the detergent composition. Since the encapsulating agent is designed to provide a releasable coating which surrounds the glasscare active salt, neither the encapsulating agent nor the release mechanism need to be the same for any type or form of the EGAS composition. Nonetheless, the encapsulated glasscare active salt comprising at least one encapsulating coating should be stable in the product matrix (i.e. liquid, gel, and/or powder) provided and also be designed to allow for the release of the glasscare active salt by dissolution and/or disruption of the at least one encapsulating coating upon triggering by a specific active release mechanism.

The following references disclose a wide variety of encapsulating methods and materials: U.S. Pat. No. 5,824,630; U.S. Pat. No. 5,783,541; U.S. Pat. No. 5,776,874; U.S. Pat. No. 5,747,438; U.S. Pat. No. 6,462,012; U.S. Pat. No. 6,440,918; U.S. Pat. No. 6,432,902; PCT Pub. No. WO 02060998A2; PCT Pub. No. WO 02060980A2; PCT Pub. No. WO 02060758A1; PCT Pub. No. WO 0242408A2; PCT Pub. No. WO 0208373A1; PCT Pub. No. WO 0188076A1; PCT Pub. No. WO 0187360A3; PCT Pub. No. WO 0183668A1; U.S. Pat. No. 6,207,632; PCT Pub. No. WO 0102529A1; PCT Pub. No. WO 0063342A1; PCT Pub. No. WO 0063341A1; PCT Pub. No. WO 0063335A1; PCT Pub. No. WO 0055288A1; PCT Pub. No. WO 0050552A1; PCT Pub. No. WO 0041522A3; U.S. Pat. No. 6,083,892; PCT Pub. No. WO 0034429A1; PCT Pub. No. WO 0014298A1; PCT Pub. No. WO 0006687A1; PCT Pub. No. WO 9914303A1; PCT Pub. No. WO 9903512A2; PCT Pub. No. WO 9813451A1; PCT Pub. No. WO 9813449A1; PCT Pub. No. WO 9811190A1; and PCT Pub. No. WO 9811186A1.

Active Release Mechanism

The encapsulated glasscare active salt may be released from the at least one encapsulating coating at any time and by any means. For example, the encapsulated glasscare active salt may be released at a specific time after beginning the wash, at a specific pH, at a specific wash liquor concentration, or after a specific phase or activity has occurred. The release of the glasscare active salt may be accomplished by the dissolution and/or disruption of the encapsulating agent or coating that surrounds the glasscare active salt. The delay or sequencing of the release of the glasscare active salt can be triggered via a number of release mechanisms including, but not limited to, time, temperature, hardness, interfacial tension, pH- sensitive, mechanical action, ionic strength, dilution, and combinations thereof.

A. Timed Release

In one non-limiting embodiment, the glasscare active salt release mechanism is by timed release. A timed release relates to a coating that disintegrates mainly as a function of time. However, a timed release does not account for different main wash durations or different wash temperatures. A second outer coating may be provided to allow greater control of the release of the glasscare active salt.

B. Temperature Release

In another non-limiting embodiment, the glasscare active salt is released by a specific temperature or temperature range common to automatic dishwashing operations. A temperature release mechanism may comprise to a coating that remains intact during the warm main wash but disintegrates during cold rinses. U.S. Pat. No. 4,765,916 discloses the use of multiple films (e.g. comprising a layer of PVA film and a layer of cellulose ether film) as a way of increasing the sensitivity of pouches designed to release in the rinse cycle. Films comprising cellulose ethers (e.g. HPMC, HBMC, and mixtures thereof) decrease in water-solubility as the temperature increases, making them more soluble in rinsewater than during the warm main wash. Premature dissolution at low wash temperatures may require a second outer coating to prevent exposure of the glasscare active salt until after warm up.

C. Hardness Release

In another non-limiting embodiment, the glasscare active salt is released by the presence of hardness. A hardness release mechanism relates to a coating that does not release in the built main wash, but releases in the calcium-rich rinse water. Poor disintegration under soft water conditions may require a second outer coating to prevent exposure of glasscare active salt until after hardness removal by the builders.

D. Interfacial Tension Release

In another non-limiting embodiment, the glasscare active salt is released due to the lack of surfactant or higher interfacial tension. An interfacial tension release mechanism relates to a coating that senses the lack of surfactants and dissolves during the higher interfacial tension rinse. Disintegration during the prewash cycle may require a second outer coating to prevent exposure of glasscare active salt until after surfactant dissolution.

E. Mechanical Action Release

In another non-limiting embodiment, the glasscare active salt is released by mechanical action. A mechanical action release mechanism relates to a coating that shears during the vigorous water spraying wash and/or rinse cycles. If release during the rinse cycle is desired, the at least one encapsulating coating could disintegrate during the main wash. Thus, a second outer coating may be provided to prevent exposure of glasscare active salt during the main wash.

F. pH-Sensitive Release

In another non-limiting embodiment, the glasscare active salt is released by a lower pH or a pH change. A pH-sensitive release mechanism relates to a coating that may, for example, remain insoluble during the alkaline main wash but disintegrates during the lower pH rinse cycle. Two types of pH-sensitive release mechanisms are: amine protonation and PVA-boric acid films.

1. pH-Sensitive Release Via Amine Protonation

In one non-limiting embodiment, the glasscare active salt can be released via dissolution and/or disruption of the encapsulating coating comprising pH-sensitive materials undergoing amine protonation. The common theme behind this class of rinse-sensitive materials is the selection of an appropriate compound with amine groups of a specific pKa, which causes them to be deprotonated at pH 10, but protonated (and hence soluble) at pH 9.

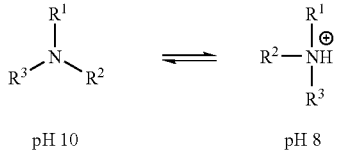

Amine Protonation (a) pH-Sensitive Release Via Polymers with Pendant Amine Groups In one non-limiting embodiment, the encapsulated glasscare active salt can be released via dissolution and/or disruption of the encapsulating coating comprising pH-sensitive materials comprising polymers with pendant amine groups. Most polymers with pendant amine groups are PVA or polycarboxylate derivatives and are applied in ethanol solution. In the Japanese Patent Nos. 49098403 and 50077406, polymers with pendant amine groups are disclosed coatings containing carboxylic acids. In later Japanese Patent Nos. 60141705, 61028440, 61028441, 61028598, 61028597, and 61028596 similar polymers were used without carboxylic acids being present.

Commercially available polymer examples include Eudragit E® and AEA Sankyo®. Eudragit E® is a non-biodegradable, polymethacrylate polymer from Roehm Pharma GmbH, Darmstadt, Federal Republic of Germany. AEA Sankyo® is a synthetic polymer containing triazine derivatives from Sankyo Company Limited, Tokyo, Japan. These polymers with pendant amine groups are formulated to disintegrate or dissolve in water A natural material, chitosan, has also been shown to have similar properties.

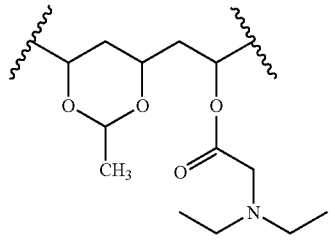

AEA Sankyo

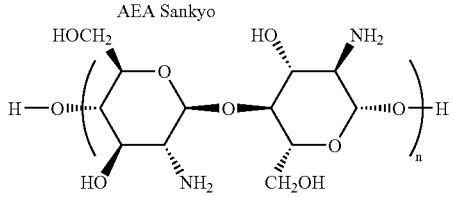

chitosan (b) Substituted Polyamines and Schiff-Base Materials

In another non-limiting embodiment, the encapsulated glasscare active salt is released via dissolution and/or disruption of the encapsulating coating comprising pH-sensitive materials comprising substituted polyamines and schiff-base materials.

A recent patent application, PCT Pub. No. WO 0017311 discloses the use of polyamine or triamine, such as N1-hydroxyethyl-N1,N2-dimethyl-N3-dodecyl-diethylenetriamine, as the release active in pH-sensitive films. It is disclosed that the presence of the dodecyl group enhances the film-forming properties of the material.

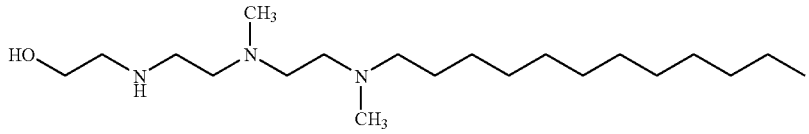

Triamine

Similar results are obtained using the imine functionality as the pH-sensitive group. It is disclosed in PCT Pub. No. WO0017311 that Schiff-base materials derived from aromatic amines and aliphatic aldehydes are particularly suitable.

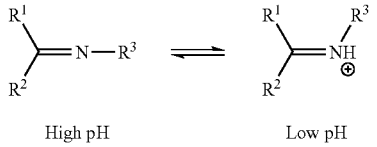

High pH Low pH

Imine pH sensitivity 2. pH and Borate Sensitivity—PVA/Boric Acid Films

In another non-limiting embodiment, the encapsulated glasscare active salt is released via dissolution and/or disruption of the encapsulating coating comprising pH- and borate-sensitive materials comprising PVA/boric acid films. The complex between borate and PVA is most stable at high pH and high borate concentration, i.e. is sensitive to two properties, which differentiate rinse cycles from the prewash or main wash (in formulations where perborate or other borate source is present).

Boric acid can be introduced to the films to ensure stability at the start of the wash.

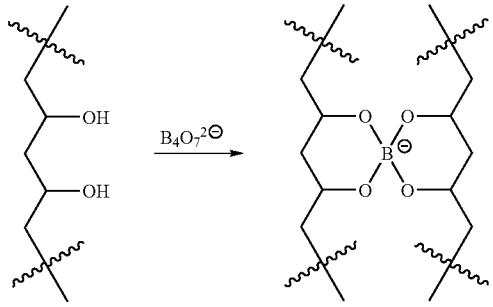

Borate-PVA complexation

PVA/boric acid films are disclosed in the U.S. Pat. Nos. 4,082,678; and 4,801,636; and 4,972,017.

G. Ionic Strength-Sensitive Release

In another non-limiting embodiment, the glasscare active salt is released by ionic strength or a change in ionic strength. An ionic strength release mechanism relates to a coating that is sensitive to the overall level of electrolyte in solution, rather than a specific ion. A second outer coating may be provided to prevent premature dissolution at the start of the wash.

1. Ionic-Strength Sensitive Polymers (a) Potassium Ion Sensitivity (κ-Carrageenan bipolymers)

In another non-limiting embodiment, the encapsulated glasscare active salt is released via dissolution and/or disruption of the encapsulating coating comprising ionic-strength sensitive materials comprising ionic-strength sensitive polymers, such as κ-Carrageenan bipolymers. The biopolymer κ-Carrageenan forms a stable complex with potassium ions and can therefore be used as part of a rinse-sensitive film in formulations containing a source of this ion. For example, PCT Pub. No. WO 00/06683 discloses the stability of the polymer-potassium complex is improved at elevated temperatures, helping to ensure the at least one encapsulating coating remains intact in a warm main wash.

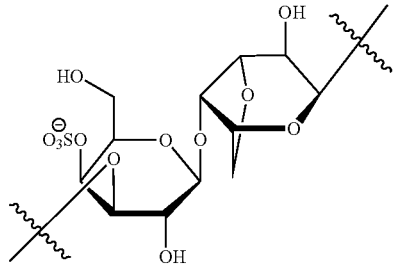

κ-Carrageenan

2. General Ionic Strength Sensitivity (Dilution) Release Mechanism

In another non-limiting embodiment, the glasscare active salt is released by dilution. A dilution release mechanism relates to dissolution of a coating based on the general ionic strength sensitivity of the at least one encapsulating coating. UK Pat. No. GB 1390503 discloses coating materials which are stable in concentrated electrolyte solutions but become soluble as ionic strength is reduced on dilution. The stated application is for bleach particle coatings which remain intact during storage in a detergent composition but are released when the product is used. Coating polymers disclosed include materials sensitive to specific ions or electrolyte in general. For example, coating polymers include various natural gums, pectins, cellulose ethers, PVA, and mixtures thereof.

Detergent Components

EGAS compositions can comprise traditional detergency components. The EGAS compositions will generally be built, but they may be non-built, and can comprise one or more detergent components which may comprise alkalinity sources, builders, surfactants, suds suppressors, enzymes, thickeners, bleaching systems (i.e. bleaching agents and catalysts), solvents, wetting agents, or mixtures thereof.

In one non-limiting embodiment, the EGAS composition can comprise an encapsulated glasscare active salt and a detergent component comprising at least one of the following: an alkalinity source, builder, surfactant, suds suppressor, enzyme, thickener, bleaching system, adjunct materials, or mixtures thereof.

Source of Alkalinity

To provide an alkaline pH, the EGAS composition may contain any suitable alkalinity source in any suitable amount. The pH may be raised to any suitable level. In certain embodiments, the alkalinity source may raise the pH of the EGAS composition to at least 10.0 in a 1 wt-% aqueous solution and or to a range of from about 10.5 to 14. Such pH is sufficient for soil removal and sediment breakdown when the chemical is placed in use and further facilitates the rapid dispersion of soils. The general character of the alkalinity source is limited only to those chemical compositions which have a substantial aqueous solubility. Alkalinity sources include, but are not limited to, alkali metal silicate, hydroxide, phosphate, carbonate, and combinations thereof. The alkalinity source can include an alkali metal hydroxide including sodium hydroxide, potassium hydroxide, lithium hydroxide, and combinations thereof.

Mixtures of these hydroxide species can also be used. Alkaline metal silicates can also act as a source of alkalinity. Useful alkaline metal silicates correspond with the general formula ($M_2O:SiO_2$) wherein for each mole of $M_2O$ there is less than one mole of $SiO_2$. For each mole of $SiO_2$ there can be from about 0.2 to about 100 moles of $M_2O$ wherein M comprises sodium and/or potassium. Other sources of alkalinity may include, but are not limited to, alkaline metal orthosilicate, alkaline metal metasilicate, and combinations thereof.

In one non-limiting embodiment, the alkalinity source may be an alkali metal carbonate that may comprise sodium carbonate, potassium carbonate, sodium and/or potassium bicarbonate or sesquicarbonate, silicate, and mixtures thereof. In another non-limiting embodiment, the alkalinity source may be a carbonate that may comprise sodium carbonate, potassium carbonate, and mixtures thereof. The sources of alkalinity can be used in EGAS compositions at concentrations about 0 wt-% to about 70 wt-%, or from about 5 wt-% to about 40 wt-%, or from about 10 wt-% to about 30 wt-%.

Builder

EGAS compositions may be provided with any suitable builder in any suitable amount. Builders suitable for use in EGAS compositions and may be present at a level of from about 1% to about 80% by weight, or from about 10% to about 70% by weight, or from about 20% to about 60% by weight of composition.

For example, builders suitable for use may include, but are not limited to, the following builders: amorphous sodium silicates, aluminosilicates, magnesioaluminosiliates, alkali metal, phosphates, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulfates, citrate, zeolite and/or layered silicate, alkaline earth and alkali metal carbonates, polycarboxylate compounds, ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids, such as ethylenediaminetetraacetic acid and nitrilotriacetic acid, as well as polycarboxylates, such as mellitic acid, succinic acid, oxydisuccinic acid, polymaleic acid, benzene 1,3,5-tricarboxylic acid, carboxymethyloxysuccinic acid, and soluble salts thereof, and citrate builders, such as citric acid and soluble salts thereof (particularly sodium salt).

In one non-limiting embodiment, the builder may comprise phosphate, phosphate oligomers or polymers and salts thereof, silicate, silicate oligomers or polymers and salts thereof, aluminosilicates, magnesioaluminosiliates, citrate, and mixtures thereof.

Enzyme

EGAS compositions may be provided with any suitable enzyme in any suitable amount. Enzymes suitable for use include, but are not limited to, hydrolases, such as proteases, amylases and lipases. Amylases and/or proteases are commercially available with improved bleach compatibility.

The EGAS composition may comprise one or more enzymes. Generally, the enzymes to be incorporated herein may include proteases, amylases, lipases, cellulases, peroxidases, and mixtures thereof. If only one enzyme is used, it is may be an amyolytic enzyme, a mixture of proteolytic enzymes and amyloytic enzymes, and combinations thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, etc. Bacterial or fungal enzymes, such as bacterial amylases and proteases, and fungal cellulases may also be used.

Enzymes may be incorporated in the instant detergent compositions at levels sufficient to provide a "cleaning-effective amount". The term "cleaning-effective amount" refers to any amount capable of producing a cleaning, stain removal or soil removal effect on substrates such as glassware and the like. Since enzymes are catalytic materials, such amounts may be very small.

In practical terms for current commercial preparations, typical amounts are up to about 5 mg by weight, more typically about 0.01 mg to about 3 mg, of active enzyme per gram of the composition. Protease enzymes are usually present in such commercial preparations at levels sufficient to provide from 0.005 to 0.1 Anson units (AU) of activity per gram of composition, or 0.01%–1% by weight of a commercial enzyme preparation.

In a non-limiting embodiment, the EGAS composition comprises from up to about 5 mg by weight of active enzyme per gram of the composition, wherein the enzyme may comprise proteases, amylases, lipases, cellulases, peroxidases, and mixtures thereof, at levels sufficient to provide from 0.005 to 0.1 Anson units (AU) of activity per gram of composition, or 0.01%–1% by weight of a commercial enzyme preparation.

Enzyme-containing EGAS compositions, especially liquid, liquid gel and gel compositions may comprise from about 0.0001% to about 10%, or from about 0.005% to about 8%, or from about 0.01% to about 6%, by weight of an enzyme stabilizing system. The enzyme stabilizing system can be any stabilizing system which is compatible with the detersive enzyme. Such stabilizing systems can comprise calcium ion, boric acid, propylene glycol, short chain carboxylic acid, boronic acid, and mixtures thereof.

For automatic dishwashing purposes, it may be desirable to increase the active enzyme content of the commercial preparations, in order to minimize the total amount of non-catalytically active materials delivered and thereby improve spotting/filming results.

In another non-limiting embodiment, the EGAS composition comprises from about 0.0001% to about 10% by weight of the total composition, an enzyme stabilizing system.

Surfactant

EGAS compositions may be provided with any suitable surfactant in any suitable amount. In EGAS compositions and methods of use in automatic dishwashing, the detergent surfactant may be a low foaming surfactant by itself or in combinations with other components (i.e. suds suppressers). In compositions and methods for use in cleaning soiled glassware prior to dishwashing, the detergent surfactant may be a foamable surfactant in direct application but low foaming in automatic dishwashing use.

Surfactants suitable for use include, but are not limited to, anionic surfactants such as alkyl sulfates, alkyl ether sulfates, alkyl benzene sulfonates, alkyl glyceryl sulfonates, alkyl and alkenyl sulphonates, alkyl ethoxy carboxylates, N-acyl sarcosinates, N-acyl taurates and alkyl succinates and sulfosuccinates, wherein the alkyl, alkenyl or acyl moiety is $C_5$–$C_{20}$, or $C_{10}$–$C_{18}$ linear or branched; cationic surfactants such as chlorine esters (U.S. Pat. No. 4,228,042, U.S. Pat. No. 4,239,660 and U.S. Pat. No. 4,260,529) and mono $C_6$–$C_{16}$ N-alkyl or alkenyl ammonium surfactants wherein the remaining N positions are substituted by methyl, hydroxyethyl or hydroxypropyl groups; low and high cloud point nonionic surfactants, and mixtures thereof including nonionic alkoxylated surfactants (especially ethoxylates derived from $C_6$–$C_{18}$ primary alcohols), ethoxylated-propoxylated alcohols (e.g., Olin Corporation's Poly-Tergent® SLF18), epoxy-capped poly(oxyalkylated) alcohols (e.g., Olin Corporation's Poly-Tergent® SLF18B—see PCT Pub. No. WO A-94/22800), ether-capped poly(oxyalkylated) alcohol surfactants, and block polyoxyethylene-polyoxypropylene polymeric compounds such as PLURONIC®, REVERSED PLURONIC®, and TETRONIC® by the BASF-Wyandotte Corp., Wyandotte, Mich.; amphoteric surfactants such as the $C_{12}$–$C_{20}$ alkyl amine oxides (for example, amine oxides suitable for use include, but are not limited to, lauryldimethyl amine oxide and hexadecyl dimethyl amine oxide), and alkyl amphocarboxylic surfactants such as Miranol™ C2M; and zwitterionic surfactants such as the betaines and sultaines; and mixtures thereof. Surfactants suitable for use are disclosed, for example, in U.S. Pat. No. 3,929,678, U.S. Pat. No. 4,259,217, EP Pat. No. A-0414 549, PCT Pub. No. WO A-93/08876 and PCT Pub. No. WO A-93/08874.

Surfactants may be present at any level. In some embodiments, the surfactant is present at from about 0% to about 50% by weight, or from about 0.5% to about 10% by weight, or from about 1% to about 5% by weight of composition. In one non-limiting embodiment, the EGAS composition comprises from about 0% to about 30% by weight, a surfactant. The surfactant may comprise anionic surfactants, cationic surfactants, nonionic surfactants, amphoteric surfactants, ampholytic surfactants, zwitterionic surfactants, and mixtures thereof. In another non-limiting embodiment, the surfactant comprises at least one anionic and nonionic surfactant at a level of about 0.2% to about 30%, by weight.

Suds Suppressor

EGAS compositions may be provided with any suitable suds suppressor in any suitable amount. Suds suppressors suitable for use may be low foaming and include low cloud point nonionic surfactants and mixtures of higher foaming surfactants with low cloud point nonionic surfactants which act as suds suppressors therein (see PCT Pub. No. WO 93/08876 and EP Pat. No. A-0705324).

Typical low cloud point nonionic surfactants which act as suds suppressors include nonionic alkoxylated surfactants, especially ethoxylates derived from primary alcohol, and polyoxypropylene/polyoxyethylene/polyoxypropylene (PO/EO/PO) reverse block polymers. Also, such low cloud point nonionic surfactants include, for example, ethoxylated-propoxylated alcohol (e.g., Olin Corporation's POLY-TERGENT® SLF18) and epoxy-capped poly(oxyalkylated) alcohols (e.g., Olin Corporation's POLY-TERGENT® SLF18B series of nonionics, as described, for example, in U.S. Pat. No. 5,576,281).

Low cloud point surfactants suitable for use are the ether-capped poly (oxyalkylated) suds suppressor having the formula:

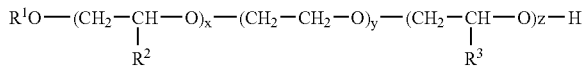

wherein $R^1$ is a linear, alkyl hydrocarbon having an average of from about 7 to about 12 carbon atoms, $R^2$ is a linear, alkyl hydrocarbon of about 1 to about 4 carbon atoms, $R^3$ is a linear, alkyl hydrocarbon of about 1 to about 4 carbon atoms, x is an integer of about 1 to about 6, y is an integer of about 4 to about 15, and z is an integer of about 4 to about 25.

Other low cloud point nonionic surfactants are the ether-capped poly(oxyalkylated) having the formula:

$$R_I O(R_{II}O)_n CH(CH_3)OR_{III}$$

wherein, $R_I$ is selected from the group consisting of linear or branched, saturated or unsaturated, substituted or unsubstituted, aliphatic or aromatic hydrocarbon radicals having from about 7 to about 12 carbon atoms; $R_{II}$ may be the same or different, and is independently selected from the group consisting of branched or linear $C_2$ to $C_7$ alkylene in any given molecule; n is a number from 1 to about 30; and $R_{III}$ is selected from the group consisting of:

(i) a 4 to 8 membered substituted, or unsubstituted heterocyclic ring containing from 1 to 3 hetero atoms; and (ii) linear or branched, saturated or unsaturated, substituted or unsubstituted, cyclic or acyclic, aliphatic or aromatic hydrocarbon radicals having from about 1 to about 30 carbon atoms;

provided that when $R^2$ is (ii) then either: (A) at least one of $R^1$ is other than $C_2$ to $C_3$ alkylene; or (B) $R^2$ has from 6 to 30 carbon atoms, and with the further proviso that when $R^2$ has from 8 to 18 carbon atoms, R is other than $C_1$, to $C_5$ alkyl.

Suds suppressors may be present at any level. In some embodiments, the suds suppressor is present at from about 0% to about 30% by weight, or about 0.2% to about 30% by weight, or from about 0.5% to about 10% by weight, or from about 1% to about 5% by weight of composition. In a non-limiting embodiment, the EGAS composition comprises from about 0.2% to about 30% by weight of composition a low foaming suds suppressor.

Bleaching System

EGAS compositions may be provided with any suitable bleaching agent or system in any suitable amount. Bleaching agents suitable for use include, but are not limited to, chlorine and oxygen bleaches. Bleaching agents include, but are not limited to, inorganic perhydrate salts (such as sodium perborate mono-and tetrahydrates and sodium percarbonate, may be optionally coated to provide controlled rate of release as disclosed in UK Pat. No. GB-A-1466799 on sulfate/carbonate coatings), preformed organic peroxyacids, and mixtures thereof. The bleaching system may comprise chlorine bleach, oxygen bleach, organic peroxyacid bleach precursors, transition metal-containing bleach catalysts (such as for example manganese or cobalt), bleach activators, and mixtures thereof. In one non-limiting embodiment, the bleaching system comprises bleaching agents comprising chlorine bleach, oxygen bleach, and mixtures thereof; organic peroxyacid bleach precursors; transition metal-containing bleach catalysts; bleach activators; or combinations thereof.

Peroxygen bleaching compounds can be any peroxide source comprising sodium perborate monohydrate, sodium perborate tetrahydrate, sodium pyrophosphate peroxyhydrate, urea peroxyhydrate, sodium percarbo- nate, sodium peroxide and mixtures thereof. In another non-limiting embodiment, peroxygen-bleaching compounds may comprise sodium perborate monohydrate, sodium perborate tetrahydrate, sodium percarbonate and mixtures thereof.

Bleaching agents or systems may be present at any level. In some embodiments, the bleaching agent or system is present at from about 0% to about 30% by weight, or about 1% to about 15% by weight, or from about 1% to about 10% by weight, or from about 2% to about 6% by weight of composition. In another non-limiting embodiment, bleaching agent or system is present in the amount from about 0% to about 15% by weight of composition.

Bleach catalysts suitable for use include, but are not limited to, the manganese triazacyclononane and related complexes (U.S. Pat. No. 4,246,612, U.S. Pat. No. 5,227,084); Co, Cu, Mn and Fe bispyridylamine and related complexes (U.S. Pat. No. 5,114,611); and pentamine acetate cobalt(III) and related complexes(U.S. Pat. No. 4,810,410) at levels from 0% to about 10.%, by weight; or from 0.1% to 1.0%.

Typical bleach activators suitable for use include, but are not limited to, peroxyacid bleach precursors, precursors of perbenzoic acid and substituted perbenzoic acid; cationic peroxyacid precursors; peracetic acid precursors such as TAED, sodium acetoxybenzene sulfonate and pentaacetylglucose; pernonanoic acid precursors such as sodium 3,5,5-trimethylhexanoyloxybenzene sulfonate (iso-NOBS) and sodium nonanoyloxybenzene sulfonate (NOBS); amide substituted alkyl peroxyacid precursors (EP Pat. No. A-0170386); and benzoxazin peroxyacid precursors (EP Pat. No. A-0332294 and EP Pat. No. A-0482807) at levels from 0% to about 10.%, by weight; or from 0.1% to 1.0%.

Other bleach activators include to substituted benzoyl caprolactam bleach activators and their use in bleaching systems and detergents. The substituted benzoyl caprolactams have the formula:

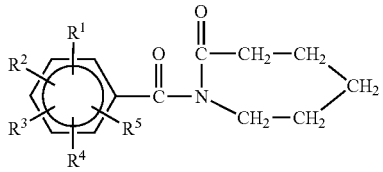

wherein $R^1$, $R^2$, $R^3$, $R^4$, and $R^5$ contain from 1 to 12 carbon atoms, or from 1 to 6 carbon atoms and are members selected from the group consisting of H, halogen, alkyl, alkoxy, alkoxyaryl, alkaryl, alkaryloxy, and members having the structure:

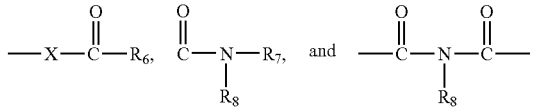

wherein $R_6$ is selected from the group consisting of H, alkyl, alkaryl, alkoxy, alkoxyaryl, alkaryloxy, and aminoalkyl; X is O, NH, or $NR_7$, wherein $R_7$ is H or a $C_1$–$C_4$ alkyl group; and $R_8$ is an alkyl, cycloalkyl, or aryl group containing from 3 to 11 carbon atoms; provided that at least one R substituent is not H.

In a non-limiting embodiment, $R^1$, $R^2$, $R^3$, and $R^4$ are H and $R^5$ is selected from the group consisting of methyl, methoxy, ethyl, ethoxy, propyl, propoxy, isopropyl, isopropoxy, butyl, tert-butyl, butoxy, tert-butoxy, pentyl, pentoxy, hexyl, hexoxy, Cl, and $NO_3$. In another non-limiting embodiment, $R^1$, $R^2$, $R^3$ are H, and $R^4$ and $R^5$ are members selected from the group consisting of methyl, methoxy, and Cl.

In a non-limiting embodiment, the bleaching system comprises: a) from about 0% to about 15% by weight, or from about 2% to about 6% by weight, of a peroxygen bleaching compound capable of yielding hydrogen peroxide in an aqueous solution; b) from about 0% to about 1.0% by weight, of one or more substituted benzoyl caprolactam bleach activators having the formula:

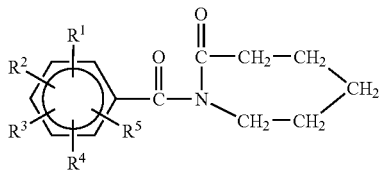

wherein $R^1$, $R^2$, $R^3$, $R^4$, and $R^5$ are as defined above.

In another non-limiting embodiment, a bleaching system comprises a bleach, a bleach catalyst, a bleach activator, and mixtures thereof. In yet another non-limiting embodiment, the EGAS composition comprises a bleaching system in an amount from about 0% to about 15%, or from about 1% to about 10%, or from about 2% to about 6% by weight of the total composition.

Adjunct Materials

EGAS compositions may be provided with any suitable adjunct material in any suitable amount. In one non-limiting embodiment, the EGAS composition can comprise one or more adjunct materials comprising sodium-based anti-corrosion agents (e.g. sodium silicate), hydrotropes (e.g. sodium cumene sulfate), disrupting agents, colorants (i.e. dyes, color speckles, and pigments), antiredopsition agents, free radical inhibitors, polymers, soil release agents, anti-filming agents, anti-spotting agents, hydrotropes, germicides, fungicides, bleach scavengers, general dishcare agents, and mixtures thereof.

Product Form

The EGAS composition may be used in any variety of product forms, including, but not limited to, liquid, granular solid, powder, liquid-gel, gel, paste, cream, and combinations thereof. In one non-limiting embodiment, the EGAS composition may be formulated as a gel to deliver an effective amount of an encapsulated glasscare active salt to the wash without gel clumping. In another non-limiting embodiment, the EGAS composition comprising encapsulated glasscare active salt could be designed to delay release of the glasscare active salt until the rinse cycle.

The EGAS composition in any physical form, e.g. powders, liquid, paste, cream, gel, liquid gels, and combinations thereof, may be packaged in water soluble or water dispersible pouch, and combinations thereof to deliver the glasscare active salt. The EGAS composition can be in the form of a unit dose, which allows for the controlled release (for example delayed, sustained, triggered or slow release) of the glasscare active salt during the wash and/or rinse cycle of an automatic dishwashing appliance.

Single- and multi-compartment water-soluble pouches may be suitable for use. In the case of additive and multi-component products, the EGAS compositions do not need to be in the same physical form. In another non-limiting embodiment, the EGAS composition may be formulated in a multi-compartmental pouch so that bleaching systems can be used without the associated stain removal negative common to detergent composition having non-encapsulated glasscare active salt/bleach interaction.

In yet another embodiment, the EGAS compositions suitable for use can be dispensed from any suitable device, such as bottles (pump assisted bottles, squeeze bottles), paste dispensers, capsules, multi-compartment bottles, multi-compartment capsules, and single- and multi-compartment water-soluble pouches, and combinations thereof.

In another non-limiting embodiment, the EGAS composition can be in the form of a unit dose which allows for the controlled release (for example delayed, sustained, triggered or slow release) of the glasscare active salt during the wash and/or rinse cycle of an automatic dishwashing appliance. In unit dose forms, the EGAS composition may be a granular solid, powder, liquid, liquid-gel, gel, paste, cream, or combinations thereof, and may be provided as a tablet or contained in a single or multi-compartment water-soluble pouch, or combinations thereof.

Method of Use

In one embodiment, a method of cleaning soiled glassware may comprise washing the glassware in an automatic dishwashing machine with an EGAS composition comprising (a) an encapsulated glasscare active salt comprising at least one of the following: aluminum, zinc, magnesium, calcium, lanthanum, tin, gallium, strontium, titanium, or mixtures thereof; (b) at least one detergent component selected from the group consisting of an alkalinity source, builder, surfactant, suds suppressor, enzyme, thickener, bleaching system, solvent, wetting agent, and mixtures thereof; (c) optionally an adjunct material; and (d) balance water. The automatic dishwashing detergent composition may be present in any form including, but not limited to, liquid, liquid gel, gel, paste, cream, granular solid, powder, or combinations thereof. The EGAS composition may deliver from about 0.1 mM to about 10 mM, or about 0.5 mM to about 5 mM, or about 1 mM to 2 mM of the glasscare active salt or complex in the wash and/or rinse cycle. The glasscare active salt may be in the form of a core particle, aggregate of core particles, prill, agglomerate, or combinations thereof and is nonfriable, water-soluble or water dispersible or which dissolve, disperse or melt in a temperature range of from about 40° C. to about 50° C.

Kit

In one embodiment, a kit may comprise (a) a package, (b) instructions for use, and (c) an EGAS composition suitable for use in automatic dishwashing comprising (i) an encapsulated glasscare active salt comprising at least one of the following: aluminum, zinc, magnesium, calcium, lanthanum, tin, gallium, strontium, titanium, or mixtures thereof; (ii) at least one detergent component selected from the group consisting of an alkalinity source, builder, surfactant, enzyme, thickener, bleaching system, solvent, wetting agent, and mixtures thereof; (iii) optionally an adjunct material; and (iv) balance water. The EGAS composition may deliver from about 0.1 mM to about 10 mM, or about 0.5 mM to about 5 mM, or about 1 mM to 2 mM of the glasscare active salt complex in the wash and/or rinse cycle. The glasscare active salt may be in the form of a core particle, aggregate of core particles, prill, agglomerate, or combinations thereof and is nonfriable, water-soluble or water dispersible or which dissolve, disperse or melt in a temperature range of from about 40° C. to about 50° C. The EGAS composition may be a granular powder, liquid, liquid-gel, and/or gel and may be provided as a tablet or contained in a single or multi-compartment water-soluble pouch, or combinations thereof.

The foregoing description can be provided to enable any person skilled in the art to make and use the invention, and can be provided in the context of a particular application and its requirements. Various modifications to the embodiments will be readily apparent to those skilled in the art, and the generic principles defined herein can be applied to other embodiments and applications without departing from the spirit and scope of the invention. The possible embodiments of this invention are not intended to be limited to the embodiments shown. Thus, since the following specific embodiments are intended only to exemplify, but in no way limit, the operation of the present invention, the present invention is to be accorded the widest scope consistent with the principles, features and teachings disclosed herein.

It should be understood that every maximum numerical limitation given throughout this specification would include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein. All documents cited are, in relevant part, incorporated herein by reference; the citation of any document can be not to be construed as an admission that it can be prior art with respect to the present invention.

What is claimed is:

1. An automatic dishwashing detergent composition for use in a wash or rinse liquor comprising:

a) from about 0.01% and about 70%, by weight of the composition of a glasscare active salt which protects glassware from corrosion;

b) at least one detergent component;

c) optionally at least one adjunct material; and d) balance water, wherein said composition is in the form of a liquid, liquid gel, gel, paste, cream, or combinations thereof, and wherein said glasscare active salt is encapsulated via at least one encapsulating agent selected from the group consisting of synthetic amine-containing polymers, chitosan, PVA-boric acid films and Schiff bases derived from aromatic amines and aldehydes which provides at least one encapsulating coating to said glasscare active salt said coating being substantially free of low critical solution temperature polymers.

2. A composition according to claim 1, wherein said glassware active salt is in the form of a core particle, aggregate of core particles, prill, agglomerate, or combinations thereof, and is nonfriable, water-soluble or water dispersible or which dissolve, disperse, or melt in a temperature range of from about 40° C. to about 50° C.

3. A composition according to claim 1, wherein the release of said glasscare active salt to the wash and/or rinse liquor is triggered by the dissolution or disruption of said at least one encapsulating coating.

4. A composition according to claim 1, wherein said liquid composition delivers from about 0.1 mM to about 10 mM of said glassware active salt or complex to said wash and/or rinse liquor.

5. A composition according to claim 1, wherein said glasscare active salt comprises at least one of the following: aluminum, zinc, magnesium, calcium, lanthanum, tin, gallium, strontium, titanium, or mixtures thereof.

6. A composition according to claim 5, wherein said glasscare active salt comprises at least one of the following: water-soluble aluminum salt, water-insoluble aluminum salt, slightly water-soluble aluminum salt, water-soluble zinc salt, water-insoluble zinc salt, slightly water-soluble zinc salt, water-soluble magnesium salt, water-insoluble magnesium salt, slightly water-soluble magnesium salt, water-soluble calcium salt, water-insoluble calcium salt, slightly water-soluble calcium salt, or mixtures thereof.

7. A composition according to claim 6, wherein said aluminum salt is aluminum sulfate.

8. A composition according to claim 1, wherein said at least one detergent component comprises at least one of the following: an alkalinity source, builder, surfactant, suds suppressor, enzyme, thickener, bleaching system, or mixtures thereof.

9. A composition according to claim 8, wherein said bleaching system comprises at least one of the following bleaching agents comprising at least one of the following: chlorine bleach, oxygen bleach, or mixtures thereof; organic peroxyacid bleach precursors; transition metal-containing bleach catalysts; bleach activators; or mixtures thereof.

10. A composition according to claim 1, wherein said dissolution or disruption of said at least one encapsulating coating occurs via a release mechanism triggered by at least one of the following release mechanism: time, temperature, hardness, interfacial tension, pH-sensitive, mechanical action, ionic strength, dilution, or combinations thereof.

11. A composition according to claim 1, wherein said composition is in the form of a unit dose which allows for the controlled release of said encapsulated glasscare active salt during the wash and/or rinse cycle of said automatic dishwashing appliance; wherein said unit dose is provided as a single or multi-compartment water-soluble pouch.

12. A method of cleaning and protecting glassware comprising the step of washing said glassware in an automatic dishwashing machine with an automatic dishwashing detergent composition according to claim 1.

* * * * *